US007530520B2

(12) United States Patent
Jones

(10) Patent No.: US 7,530,520 B2
(45) Date of Patent: May 12, 2009

(54) APPARATUS AND METHOD FOR WINDING WIRE

(75) Inventor: Michael D. Jones, Neosho, MO (US)

(73) Assignee: Tru 2 Form Ventures, Inc., Neosho, MO (US)

( * ) Notice: Subject to any disclaimer, the term of this patent is extended or adjusted under 35 U.S.C. 154(b) by 309 days.

(21) Appl. No.: 11/276,331

(22) Filed: Feb. 24, 2006

(65) Prior Publication Data

US 2007/0200024 A1 Aug. 30, 2007

(51) Int. Cl.
*B65H 75/40* (2006.01)

(52) U.S. Cl. ..... 242/403

(58) Field of Classification Search ..... 242/486.8, 242/403, 389, 390, 390.5, 390.7, 390.6, 390.8, 242/390.9, 390.2, 404, 398, 598.3, 598.4, 242/598.5, 599.3, 597.6, 597.7, 597.8, 401
See application file for complete search history.

(56) References Cited

U.S. PATENT DOCUMENTS

| | | | | |
|---|---|---|---|---|
| 2,793,820 | A * | 5/1957 | Torgeson | 242/390.7 |
| 3,863,859 | A * | 2/1975 | Keith | 242/389 |
| 3,920,194 | A * | 11/1975 | Parsen | 242/591 |
| 4,050,641 | A | 9/1977 | Henrich | 242/47 |
| 4,071,199 | A | 1/1978 | Jones | 242/25 |
| 4,274,603 | A | 6/1981 | Lenders et al. | 242/7.14 |
| 4,553,707 | A | 11/1985 | Henrich | 242/25 |
| 4,781,335 | A | 11/1988 | Compagnon | 242/54 |
| 4,925,435 | A | 5/1990 | Linklater | 474/101 |
| 5,246,182 | A | 9/1993 | Lester | 242/86.5 |
| 5,551,644 | A | 9/1996 | Linderoth | 242/158.4 |
| 5,632,136 | A | 5/1997 | Luchenbill et al. | 57/18 |
| 6,042,046 | A | 3/2000 | Beyer, Sr. | 242/559.1 |
| 6,290,166 | B1 | 9/2001 | Aramaki et al. | 242/484.4 |

* cited by examiner

*Primary Examiner*—Peter M Cuomo
*Assistant Examiner*—William E Dondero
(74) *Attorney, Agent, or Firm*—Wood, Herron & Evans, LLP

(57) ABSTRACT

An apparatus for winding wire upon a reel or spool includes a support for receiving the reel thereon. A spindle arm coupled to the reel support is received within an annular bearing surface of a spindle support for rotation about an axis through the annular bearing surface. A drive member, such as a Kelly Bar provided on a boom of a digger/derrick truck, may be received within a bore associated with the spindle to rotate the spindle and reel support. A reel supported on the reel support is thereby rotated to wind wire onto the reel.

15 Claims, 7 Drawing Sheets

APPARATUS AND METHOD FOR WINDING WIRE

FIELD OF THE INVENTION

The present invention relates generally to wire winding, and more particularly to an apparatus and methods for winding wire on a reel or spool.

BACKGROUND OF THE INVENTION

In various applications and industries it is often desired to install long lengths of cable, wire, or other similar elongate, flexible materials. For example, in the utility service industries it is often desired to install lengths of wire or cable for transmitting power, television or telephone signals. The wire or cable is typically supplied in long lengths coiled upon a spool or reel. After the wire has been installed, unused lengths of the wire must be collected for reuse or disposal. In some situations where new wire is being installed to replace older wire, the unused portions of the new wire, as well as the old wire, must be collected.

In such applications, it is generally desired to wind the unused or old wire back onto a reel or spool for subsequent reuse or disposal. Conventional equipment for winding wire is generally very complex and bulky, and therefore not suitable for use in the field where new wire is being installed. Collapsible-style take up reels are also generally awkward to use and are not suited for placing wire onto a removable reel. A need therefore exists for an apparatus and methods for winding unused wire onto a reel that overcomes these and other drawbacks of the prior art.

SUMMARY OF THE INVENTION

The present invention overcomes the foregoing and other shortcomings and drawbacks of wire winding devices heretofore known for use in various commercial and industrial environments. While the invention will be described in connection with certain embodiments, it will be understood that the invention is not limited to these embodiments. On the contrary, the invention includes all alternatives, modifications and equivalents as may be included within the spirit and scope of the present invention.

According to one aspect of the present invention, a portable apparatus for winding wire upon a removable reel or spool includes a reel support for supporting a reel thereon. The reel support is coupled to a spindle arm that is received within an annular bearing surface of a spindle support for rotation about an axis through the bearing surface. A bore associated with the spindle arm is configured to receive a drive member for rotating the spindle arm and reel support, to thereby rotate the reel so that wire may be wound onto the reel.

In another aspect of the invention, the reel support includes at least one mounting member to facilitate securing a reel to the reel support. In one embodiment, the mounting member comprises one or more pins that are selectively adjustable along the reel support in at least one direction extending radially from the axis through the bearing surface.

In another aspect of the invention, the apparatus includes a drive tube coupled to the reel support and the spindle arm. The drive tube has an axial bore adapted to receive the drive member, whereby the spindle and reel support may be driven by rotation of the drive member. A locking member on the drive tube facilitates transmitting rotation of the drive member to the drive tube. In one embodiment, the locking member comprises a pin received in an aperture through the drive tube.

In another embodiment, the locking member is defined by a cross-sectional shape of the bore through the drive tube.

In yet another aspect of the invention the drive member includes a kelly bar on a boom of a digger/derrick truck, and the axial bore through the drive tube is adapted to receive the kelly bar therethough. Actuation of the kelly bar thereby rotates the drive tube, spindle arm, and reel support to rotate a reel on the reel support so that wire may be wound onto the reel.

In another aspect of the invention, an apparatus for winding wire onto a reel includes a stand for supporting the spindle arm above a ground surface. In one embodiment, a spindle support can be removably secured to the stand. In another embodiment, the stand is convertible between a first configuration wherein the stand is adapted to stably support the spindle support, and a second configuration wherein the stand is made compact for storage.

In yet another aspect of the invention, a method of winding wire onto a reel includes supporting the reel on a spindle, coupling a drive member from the boom of a derrick truck to the spindle, and rotating the spindle with the drive member so that the reel rotates to wind the wire thereon.

These and other features, advantages, and objectives of the invention will become more readily apparent to those of ordinary skill in the art upon review of the following detailed description and accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Figure 1:
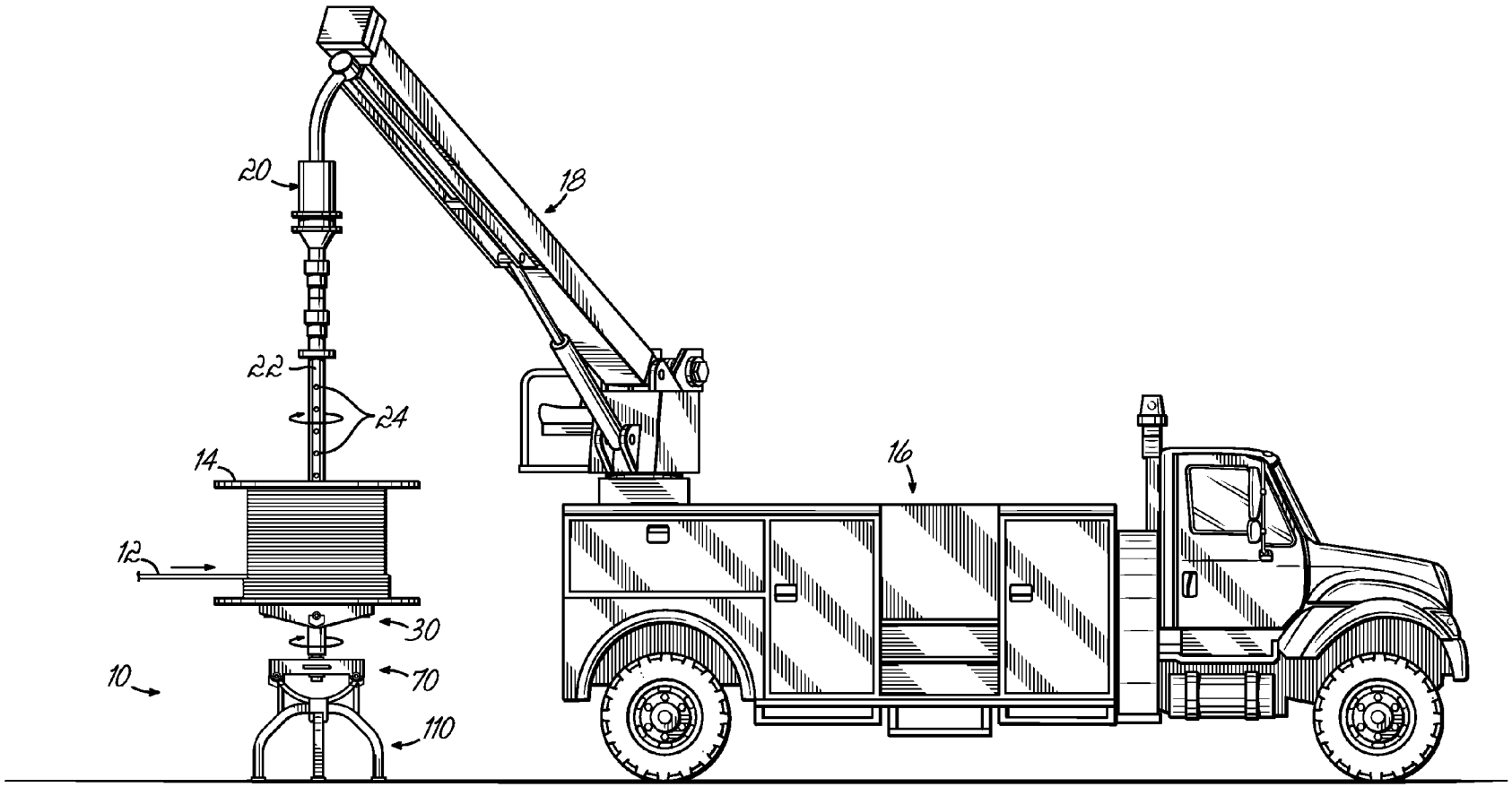
FIG. 1 is a schematic illustration depicting an exemplary apparatus for winding wire, in accordance with the principles of the present invention, and being used with a digger/derrick truck.
Figure 2:
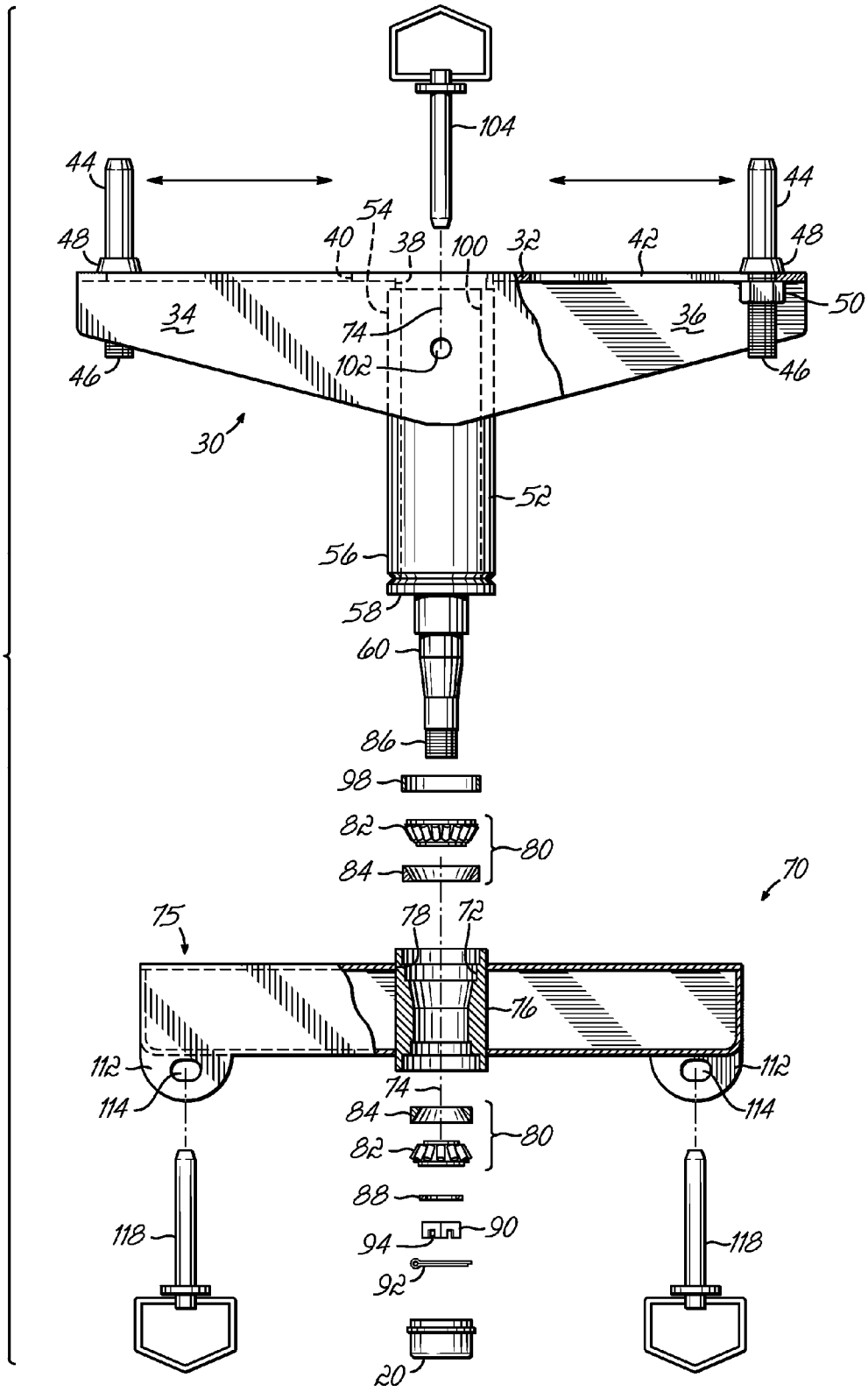
FIG. 2 is an exploded elevation view of a portion of the apparatus of FIG. 1.
Figure 3:
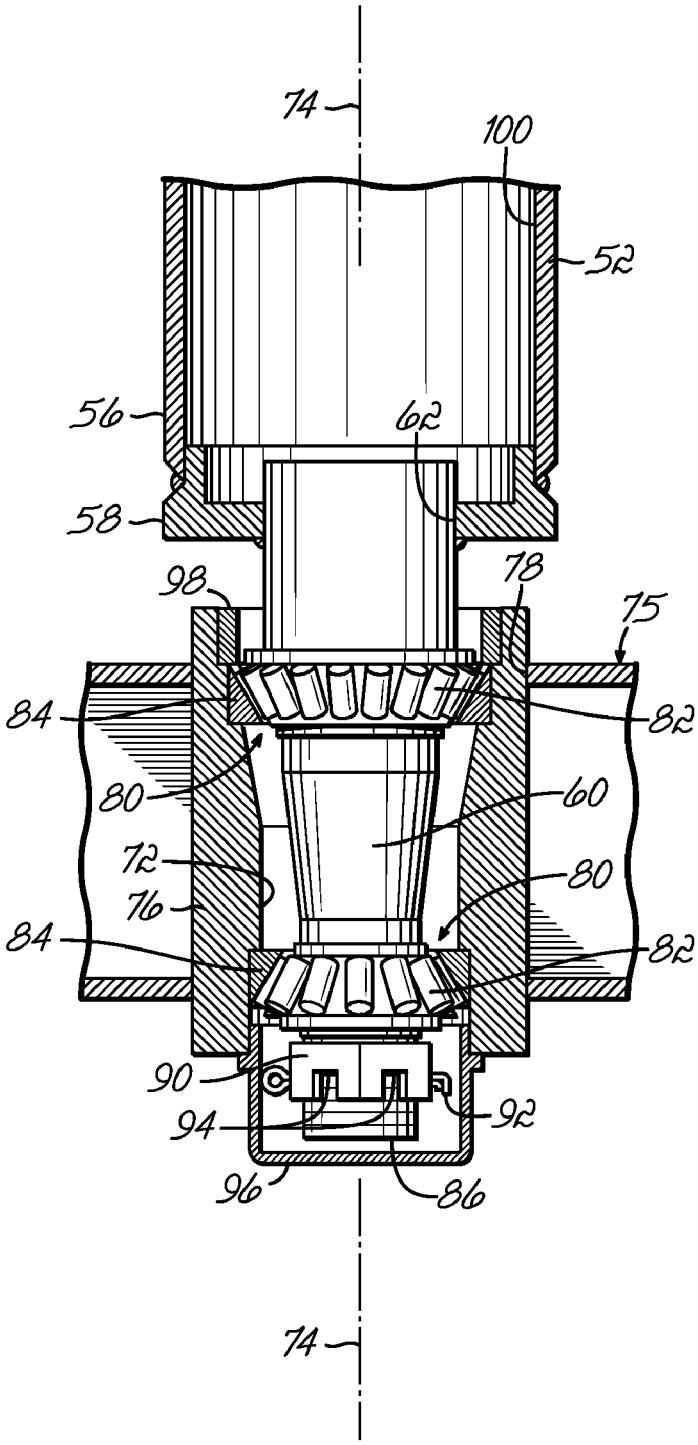
FIG. 3 is an enlarged cross-sectional view of the apparatus of FIG. 2 in an assembled condition.

FIG. 1 illustrates an exemplary apparatus 10 for winding wire 12 upon a reel 14 in accordance with the principles of the present invention. FIG. 1 depicts the apparatus 10 supporting a reel or spool 14 and being used with a conventional digger/derrick truck 16 to wind wire 12 upon the reel 14. The digger/derrick truck 16 has a hydraulic-powered boom 18 that is rotatable about a pivot point on the truck 16, and which can be raised and lowered to perform various operations during the installation of utility service poles. The boom 18 includes a drive member 20 that is typically used to drive an auger (not shown) for drilling holes in the ground during installation of utility poles. The end of the drive member 20 typically includes a six-sided steel shaft 22, commonly referred to as a "kelly bar". The kelly bar 22 includes apertures 24 provided at various locations along its length for receiving pins to attach augers and other tools to the kelly bar 22. In the embodiment shown, the kelly bar 22 of the drive member 20 is inserted through an axially extending hole through the center of the reel 14 and is coupled to the wire winding apparatus 10 as will be described in more detail below. The drive member 20 may then be actuated to rotate the wire winding apparatus 10 and the reel 14, such that wire 12 is wound upon the reel 14 generally as depicted in FIG. 1.

With continued reference to FIG. 1, and referring further to FIGS. 2-5, the apparatus 10 includes a reel support 30 for mounting a reel 14 that will receive the wire 12 to be wound. In the embodiment shown, the reel support 30 comprises a generally elongate channel having an end wall 32 and first and second oppositely disposed sidewalls 34, 36 extending from the end wall 32. The end wall 32 has a central aperture 38 for receiving the drive member 20 of boom 18 therethrough, and elongate slots 40, 42 disposed on either side of the central aperture 38. The channel is formed from 0.25-inch thick hot rolled, pickled and oiled (HRPO) steel plate that has been formed and machined into the shape generally shown.

The reel support 30 may further include mounting pins 44 secured to the end wall 32 and extending upwardly therefrom for engaging an aperture or other feature on the reel 14 when the reel 14 is placed on the reel support 30 to engage the end wall 32. In the embodiment shown, the pins 44 have threaded first ends 46 received through the slots 40, 42 and collars 48 disposed along the lengths of the pins 44 for engaging the end wall 32 and preventing the pins 44 from passing fully through the slots 40, 42. Accordingly, the pins 44 may be positioned at various locations within the slots 40, 42 to correspond to apertures or other features on the reel 14, whereafter the pins 44 may be secured at a desired location by tightening corresponding nuts 50 installed over the threaded ends 46 of the pins 44. In the embodiment shown, the apparatus 10 includes first and second mounting pins 44, but it will be appreciated that the apparatus 10 may alternatively have only a single pin 44, or it may have more than two pins 44, as may be desired.

An elongate drive tube 52 has a first end 54 received within the channel defined by the end wall 32 and the oppositely disposed sidewalls 34, 36 of the reel support 30. The first end 54 generally abuts the end wall 32 and is fixed within the channel by welding, press fit, adhesives, or various other methods suitable for securely attaching the first end 54 of the drive tube 52 to the reel support 30. The second end 56 of the drive tube 52 extends outwardly from the channel in a direction away from the end wall 32. The drive tube 52 is formed from 3.5-inch outer diameter steel tube having a 0.25-inch wall thickness. The tube is machined to have the configuration generally shown, and an end plate 58 machined from 3.5-inch diameter hot-rolled steel bar stock is welded about its circumference to the second end 56 of the steel tube. A spindle arm 60, machined from 2-inch steel bar stock into the configuration generally shown, is coupled to the second end 56 of the drive tube 52 and extends generally axially outwardly therefrom. The spindle arm 60 extends through a central aperture 62 (FIG. 3) formed in the end plate 58 and is welded around its circumference to the end plate 58. While the spindle arm 60 is shown and described herein as being welded to the drive tube 52, it will be recognized that various other methods for securing the spindle arm 60 to the drive tube 52 may be used, such as press fitting, mechanically crimping, threadably coupling, or various other methods.

The wire winding apparatus 10 further includes a spindle support 70 having a generally annular bearing surface 72 extending along a first axis 74. The spindle arm 60 is received within the bearing surface 72 for rotation about the first axis 74. In the embodiment shown, the spindle support 70 comprises a generally elongate tubular member 75 formed from 0.25-inch thick HRPO steel plate that has been formed, machined and welded to have the configuration generally shown. The bearing surface 72 is defined by the inner bore of a cylindrical member 76 formed from 3-inch outer diameter HRPO steel bar stock that has been machined to the configuration generally shown. The cylindrical member 76 is inserted within a central aperture 78 formed through the elongate tubular member 75 and is welded thereto.

The spindle arm 60 is received within the bore of the cylindrical member 76 and is supported for rotational movement therein by a pair of rolling element bearing assemblies 80 mounted between the spindle arm 60 and the bearing surface 72. In the embodiment shown, the rolling element bearing assemblies 80 include cylindrically-shaped thrust bearings 82 in respective bearing races 84. The distal end 86 of the spindle arm 60 is threaded to receive a washer 88 and nut 90 for securing the spindle arm 60 and bearings 80 within the bearing surface 72 of the spindle support 70. In the embodiment shown, a castle nut 90 is used to secure the spindle arm 60 to the spindle support 70 and a cotter pin 92 installed through apertures 94 on the castle nut 90 helps to retain the nut 90 on the threaded end 86 of the spindle arm 60. A dust cap 96 fitted over the distal end 86 of the spindle arm 60 and a shaft seal 98 mounted to the spindle arm 60 between the cylindrical member 76 and the drive tube 52 help keep the bearing assembly free from dirt and other debris.

A central bore 100 extending axially through the drive tube 52 is sized to receive an operative end of the drive member 20, such as a kelly bar 22 provided on the boom 18 of a digger/derrick truck 16. Accordingly, the kelly bar 22 or other implement for driving the wire winding apparatus 10 may be received through an axial hole through the center of a reel 14 supported on the apparatus 10, through the central aperture 38 on the reel support 30 and into the axial bore 100 of the drive tube 52. The drive tube 52 is thereafter secured to the kelly bar 22 so that it will rotate with the kelly bar 22 and thereby rotate the reel 14 supported on the reel support 30. In one embodiment shown in FIG. 4, an aperture 102 (FIG. 2) is formed through the drive tube 52, and through the oppositely disposed sidewalls 34, 36 of the reel support 30. As the kelly bar 22 is inserted within the drive tube 52, one of the apertures 24 provided along the length of the kelly bar 22 is aligned with the aperture 102 formed through the drive tube 52 and the sidewalls 34, 36 of the reel support 30. A suitable drive pin 104 may thereafter be installed through the drive tube 52 and kelly bar 22 so that the drive tube 52 is pinned to the kelly bar 22 for rotational movement therewith.

Figure 4:
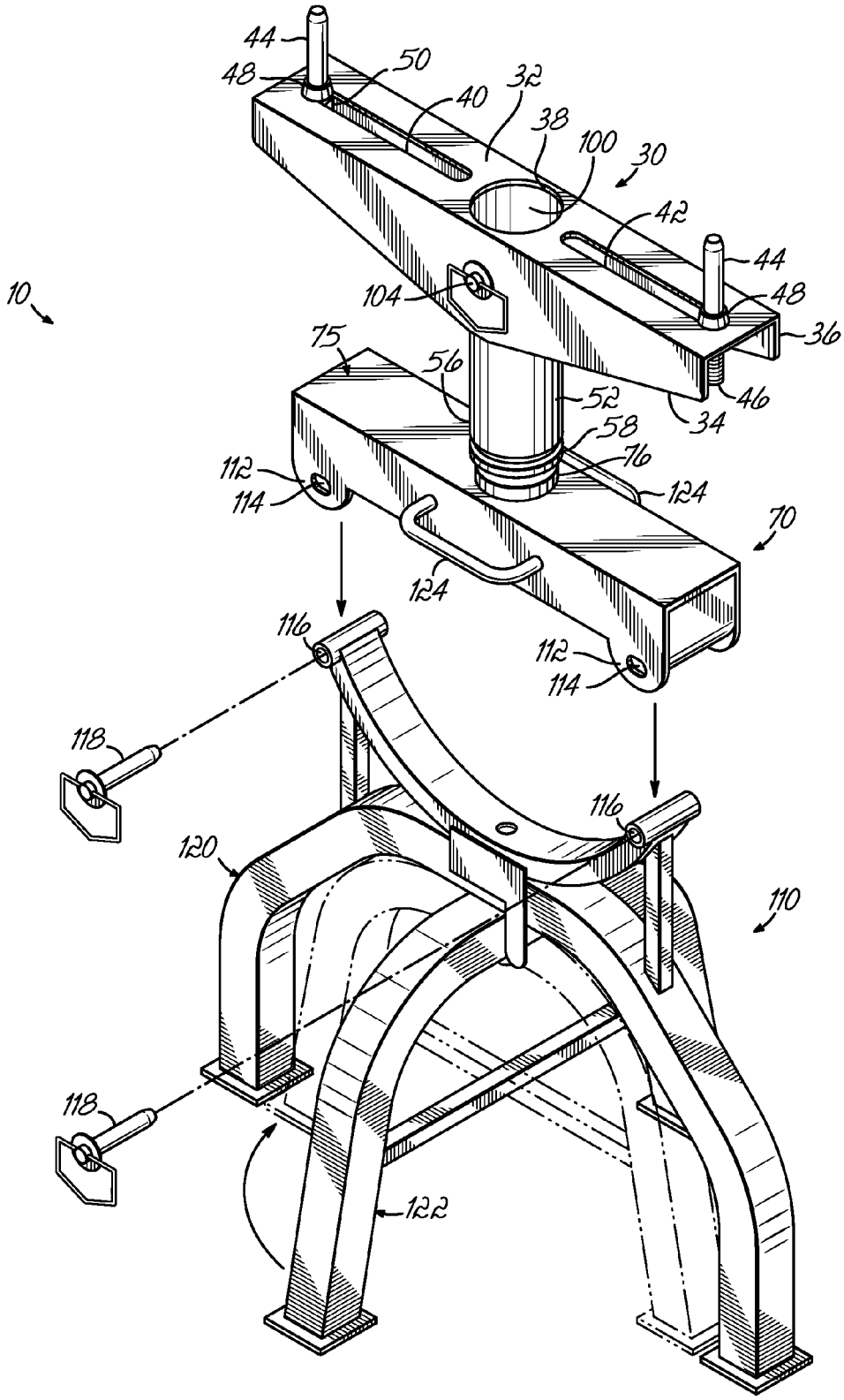
FIG. 4 is a partially exploded perspective view of the apparatus of FIG. 1.
Figure 4A:
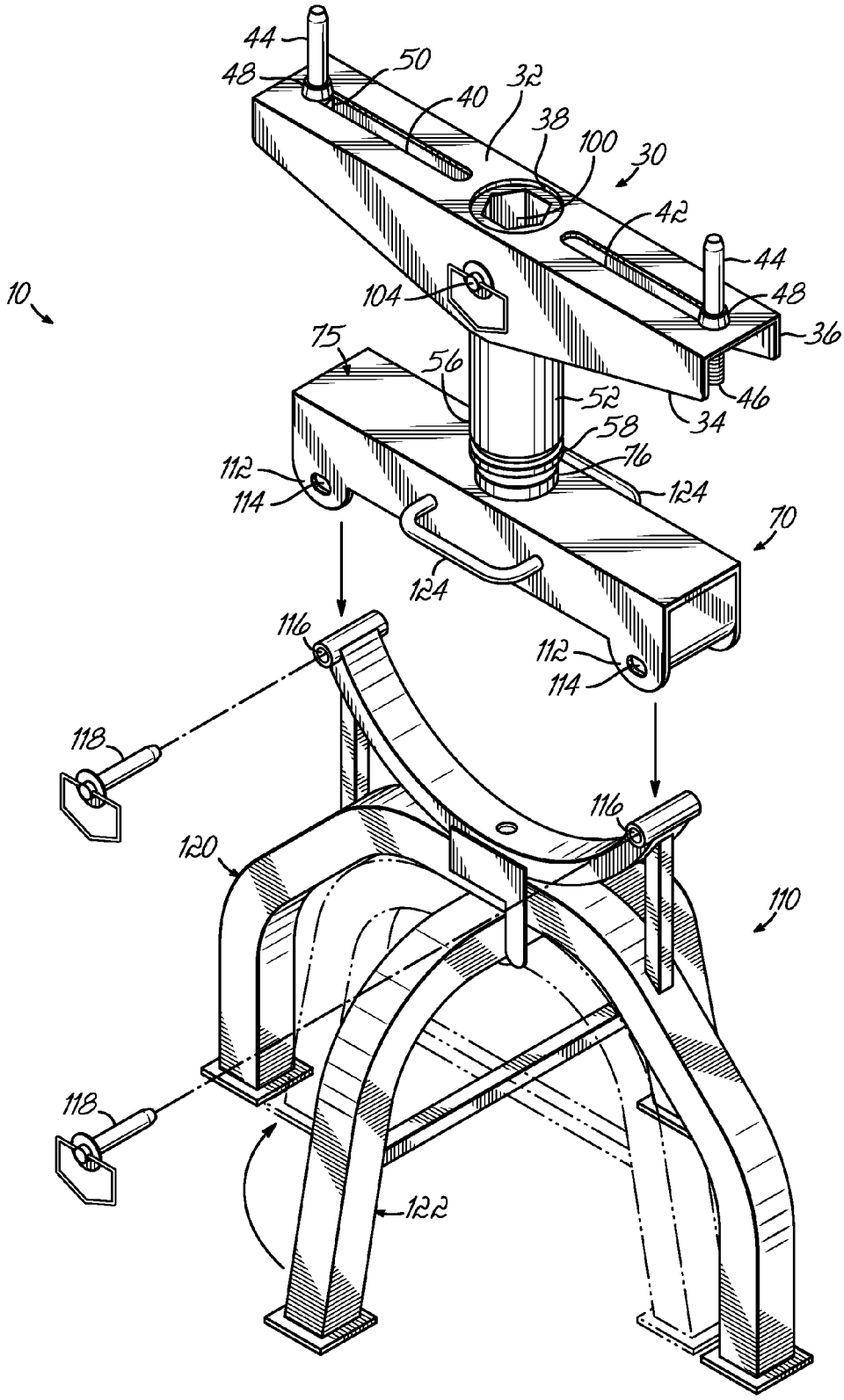
FIG. 4A is a partially exploded perspective view, similar to FIG. 4, depicting another embodiment of an apparatus for winding wire in accordance with the principles of the present invention.

In another exemplary embodiment shown in FIG. 4A, the central bore 100 of the drive tube 52 has a cross-sectional shape configured to engage the outer surface of a kelly bar 22 or other implement, so that rotational movement of the kelly bar 22 is transmitted to the drive tube 52 and reel support 30. It will be recognized, however, that various other methods for securing the drive tube 52 to a kelly bar 22 or various other implements rotatably supported on the boom 18 of a digger/derrick truck 16 may be used to transmit rotation of the drive member to the drive tube 52.

Figure 5:
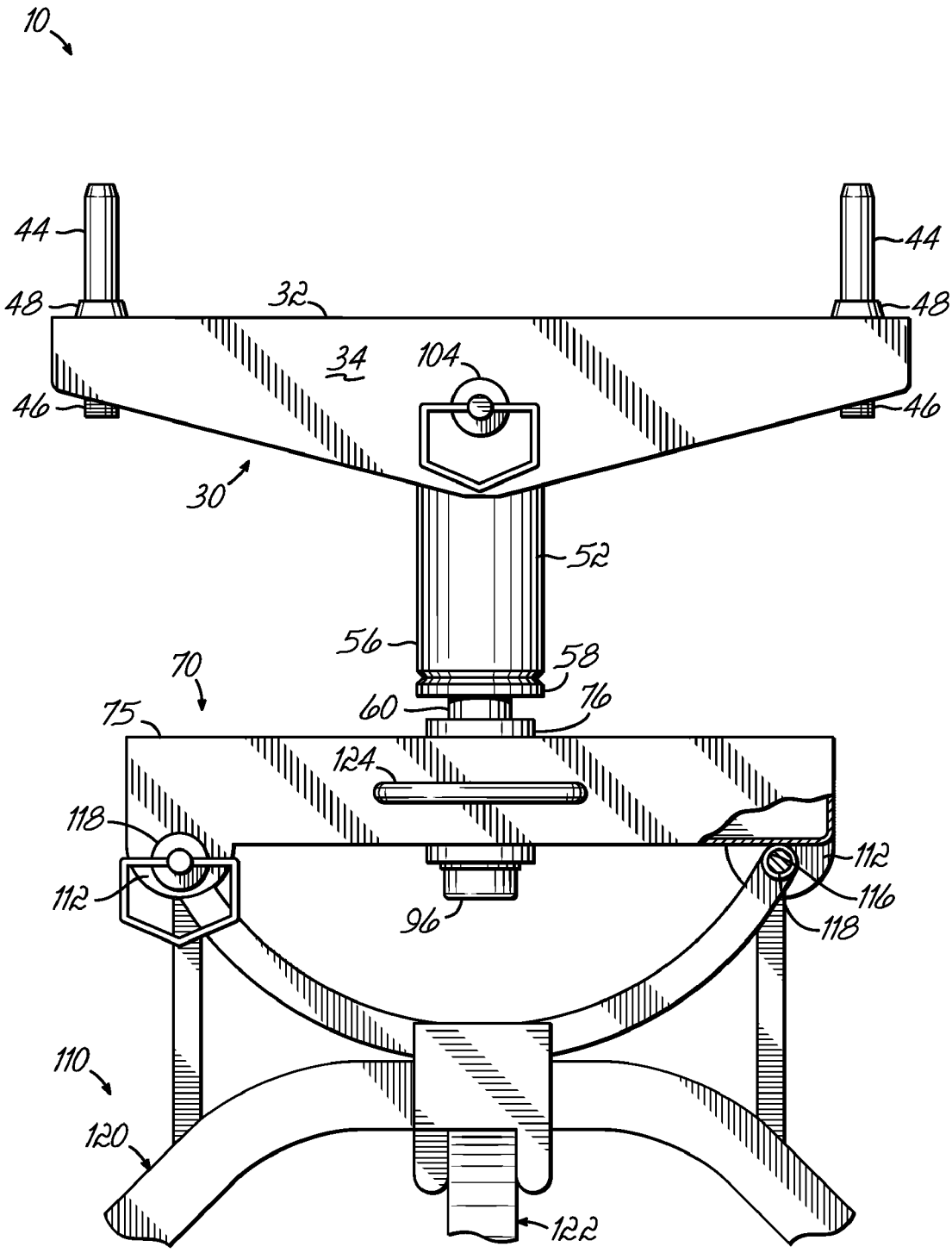
FIG. 5 is an enlarged elevation view of the apparatus of FIG. 4 shown in an assembled condition.

Referring now to FIGS. 4 and 5, the apparatus 10 may further include a stand 110 for supporting the reel support 30 above a ground surface. In the embodiment shown, downwardly extending tabs 112 are provided on a lower portion of the spindle support 70. Apertures 114 formed through the tabs 112 are positioned to register with corresponding mounting apertures 116 provided on the stand 110. The spindle support 70 may thereby be placed upon the stand 110 with the mounting apertures 114 of the spindle support 70 aligned with the mounting apertures 116 on the stand 110. Fasteners, such as bolts or pins 118 may thereafter be installed through the corresponding mounting apertures 114, 116 to releasably secure the spindle support 70 to the stand 110.

In one embodiment, the stand 110 has first and second pairs of legs 120, 122 that are selectively positionable relative to one another such that the stand 110 is convertible between a first configuration wherein the pairs of legs 120, 122 are arranged in substantially perpendicular alignment to provide a stable base for supporting the spindle support 70 thereon (FIG. 4 solid lines), and a second configuration wherein the pairs of legs 120, 122 are rotated to a compact position that facilitates storage of the stand 110 when not in use (FIG. 4 phantom lines). Such a stand 110 is disclosed in co-pending U.S. patent application Ser. No. 10/980,376, assigned to the Assignee of the present invention.

Figure 6:
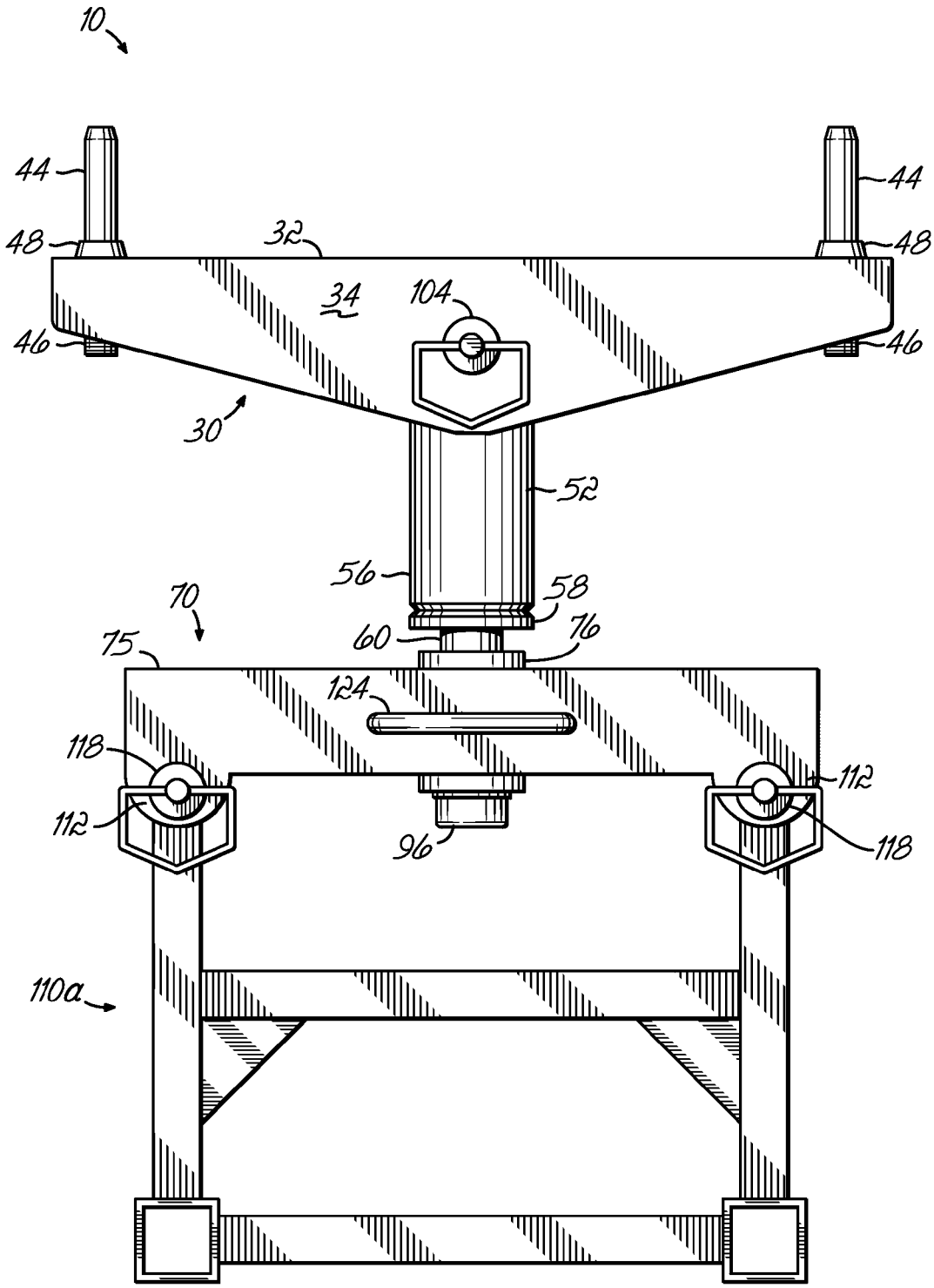
FIG. 6 is an elevation view of another exemplary apparatus for winding wire, in accordance with the principles of the present invention.

FIG. 6 depicts an alternate embodiment wherein a stand 110*a* for supporting the reel support 30 above a ground surface comprises generally fixed tubular frame members that are not convertible between a use configuration and a compact configuration. The spindle support 70 may further include handles 124 to facilitate securing the spindle support to a stand 110, 110*a*, or to facilitate carrying the wire winding apparatus 10 to a desired location.

Some or all of the components of a wire winding apparatus in accordance with the principles of the present invention may be processed or treated, such as by painting, powder coating, or by various other methods, to provide corrosion protection, aesthetic or functional appearance, or a combination thereof. While various exemplary embodiments of a wire winding apparatus in accordance with the principles of the present invention have been shown and described herein as comprising components made from steel plate, tube, or bar stock that have been machined, formed, welded, or otherwise worked to have the general configuration of the exemplary embodiments, it will be understood that various other methods for making some or all of the components of a wiring winding apparatus may be used, including, but not limited to, casting, forging, extruding, or various other manufacturing methods. Accordingly the invention is not limited to the exemplary embodiments shown and described herein.

In use, a wire winding apparatus 10 in accordance with the principles of the present invention may be transported to a desired location in the field and placed upon a ground surface. The mounting pins 44 may be selectively adjusted to appropriate positions to correspond with apertures or other mounting features on a reel 14 for winding wire 12 thereon. The reel 14 may then be placed upon the reel support 30 to engage the mounting pins 44. An implement from a drive member 20, such as a kelly bar 22 provided on the hydraulic boom 18 of a digger/derrick truck 16, may be inserted through an axial hole through the center of the reel 14 and into the axial bore 100 of the drive tube 52. The drive tube may be secured for rotation with the drive member 20, such as by inserting drive pin 104 through aperture 102 of reel support 30 and a corresponding aperture on the kelly bar 22. An end of a length of wire 12 may be secured by known methods to the reel 14 whereafter the drive member 20 may be actuated to cause the drive tube 52 and reel support 30 to rotate about the first axis 74 so that wire 12 may be wound upon the reel 14 as depicted in FIG. 1.

When the wire 12 has been wound upon the reel 14, drive member 20 is stopped and drive pin 104 is removed to permit the kelly bar 22 to be withdrawn from the wound reel 14. The wound reel 14 may thereafter be removed from the wire winding apparatus 10, for example, using a winch associated with boom 18, or by various other methods.

While the present invention has been illustrated by the description of one or more embodiments thereof, and while the embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of Applicant's general inventive concept.

What is claimed is:

1. An apparatus for winding wire about a reel axis of a reel, the apparatus comprising:

a spindle support having an annular bearing surface along a first axis;

a spindle arm received in said bearing surface and rotatable about said first axis;

a reel support directly coupled to said spindle arm for rotation therewith relative to said spindle support, said reel support including a reel engagement surface for supporting the reel with the reel axis substantially parallel to said first axis;

an elongate drive tube defining a bore and having first and second ends said bore associated with said spindle arm, said bore configured to receive a drive member for rotating said spindle arm and said reel support;

wherein said reel comprises an elongate channel defined by an end wall and first and second opposed sidewalls extending from said wall; and said first end of said drive tube received within said channel between said first and second sidewalls;

said second end of said drive tube extending outwardly from said channel and contacting and directly fixed to said spindle arm.

2. The apparatus of claim 1, further comprising at least one mounting member on said reel support to facilitate securing the reel to said reel support for rotation with said spindle arm.

3. The apparatus of claim 2, wherein said mounting member is selectively positionable on said reel support along at least one direction extending radially from said first axis.

4. The apparatus of claim 2, wherein said mounting member comprises a mounting pin extending in a direction generally parallel to said first axis and adapted to be received in an aperture on the reel to facilitate securing the reel to said reel support for rotation with said spindle arm.

5. The apparatus of claim 4, comprising first and second mounting pins, each of said first and second mounting pins being adjustable along a direction extending radially from said first axis.

6. The apparatus of claim 1, wherein said bore associated with said spindle arm comprises an axial bore through said drive tube, said axial bore adapted to receive the drive member for rotating said spindle arm and said reel support;

the apparatus further comprising an aperture formed through said end wall of said reel support and in registration with said axial bore through said drive tube.

7. The apparatus of claim 6, wherein the drive member includes a kelly bar on a boom of a derrick truck and said axial bore is adapted to receive the kelly bar therethrough.

8. The apparatus of claim 6, further comprising a locking member on said drive tube to facilitate transmitting rotation of the drive member to said drive tube.

9. The apparatus of claim 8, wherein said drive tube includes an aperture, substantially perpendicular to said first axis, and said locking member comprises a pin sized to be received through said aperture in said drive tube.

10. The apparatus of claim 8, wherein said locking member is defined by a cross-sectional geometry of said axial bore through said drive tube.

11. The apparatus of claim 1, further comprising at least one rolling element bearing assembly disposed between said bearing surface and said spindle arm.

12. The apparatus of claim 1, further comprising a stand for supporting said spindle support above a ground surface.

13. The apparatus of claim 12, wherein said stand is convertible between a first configuration wherein said stand is adapted to stably support said spindle support, and a second configuration wherein said stand is made compact for storage.

14. The apparatus of claim 12, wherein said spindle support is configured to be removably attached to said stand.

15. The apparatus of claim 14, further comprising:

corresponding mounting apertures formed in said spindle support and said stand; and at least one fastener for coupling said spindle support and said stand through said mounting apertures.

* * * * *

UNITED STATES PATENT AND TRADEMARK OFFICE

CERTIFICATE OF CORRECTION

PATENT NO. : 7,530,520 B2
APPLICATION NO. : 11/276331
DATED : May 12, 2009
INVENTOR(S) : Michael D. Jones It is certified that error appears in the above-identified patent and that said Letters Patent is hereby corrected as shown below:

Column 6
Line 32, Claim 1, reads "second ends said bore associated with" and should read -- second ends, said bore associated with --.

Column 7
Line 5, Claim 9, reads "includes an aperture, substantially perpendicular" and should read -- includes an aperture substantially perpendicular --.

Signed and Sealed this

Second Day of February, 2010

David J. Kappos

David J. Kappos
*Director of the United States Patent and Trademark Office*